United States Patent [19]

Rochman

[11] 4,327,796

[45] May 4, 1982

[54] SHUTTER ASSEMBLY

[75] Inventor: Itzchak Rochman, Hampstead, Canada

[73] Assignee: Olympic Aluminum Mfg., Ltd., Canada

[21] Appl. No.: 141,348

[22] Filed: Apr. 18, 1980

[51] Int. Cl.[3] ..... E06B 3/32

[52] U.S. Cl. ..... 160/101; 49/DIG. 1; 160/26

[58] Field of Search ..... 160/101, 98, 236, 26, 160/33; 49/63, DIG. 1

[56] References Cited

U.S. PATENT DOCUMENTS

| | | | |
|---|---|---|---|
| 1,096,556 | 5/1914 | Newpher | 160/101 |
| 1,908,989 | 5/1933 | Lahey et al. | 160/26 X |
| 2,068,243 | 1/1937 | McLaughlin, Jr. | 160/26 |
| 2,446,375 | 8/1948 | Liberty | 160/101 |
| 3,065,507 | 11/1962 | Cloutier et al. | 49/63 |
| 3,186,473 | 6/1965 | Myers et al. | 160/98 X |
| 3,222,734 | 12/1965 | Punt | 49/63 X |
| 3,780,473 | 12/1973 | Kort et al. | 49/DIG. 1 |
| 3,908,730 | 9/1975 | Goss, Jr. et al. | 49/63 X |
| 4,151,682 | 5/1979 | Schmidt | 49/DIG. 1 |
| 4,197,896 | 4/1980 | Reichstadt | 160/26 X |
| 4,234,632 | 11/1980 | Stark | 160/26 |

*Primary Examiner*—Philip C. Kannan

*Attorney, Agent, or Firm*—Thomas J. Greer, Jr.

[57] ABSTRACT

A combined window and blind unit having a window frame, an inner glass assembly and an outer glass assembly. First and second spaced-apart mounting means are provided on the frame for mounting the inner and outer glass assemblies. A blind is stored adjacent the glass assemblies and means are provided for moving the blind from its stored position into the space between the glass assemblies through an opening in the frame. Guide means for the blind are provided between the first and second mounting means. The guide means preferably is made from a material which acts as a thermal barrier.

5 Claims, 5 Drawing Figures

SHUTTER ASSEMBLY

BACKGROUND OF THE INVENTION

1. Field of the Invention

This invention is directed toward an improved, combined window and blind unit.

2. Description of the Prior Art

Blinds, including thick insulating blinds and slat-type, shutter blinds are commonly employed adjacent the interior or inner side of a window. The blinds are hung just above the window and are unrolled to cover all or part of the window to screen out light and/or to insulate the window. The blinds can present an unsightly appearance, however, stored above the window, particularly when they require a relatively large storage space as required by thick insulating blinds. In addition, separate unsightly guide means are often provided on the sides of the window to securely guide the insulating blinds in order to properly insulate the window when the blind is drawn. If the edges of the blind are not positioned close to the sides of the window, the insulating efficiency of the blind is greatly reduced.

It is known to employ blinds in a window, which blinds are located between the inner and outer glass assemblies, as shown in U.S. Pat. No. 3,153,819, issued Oct. 27, 1964, Bond, and U.S. Pat. No. 3,201,832, issued Aug. 24, 1965, Hordis et al, by way of example. These blinds are of the type comprising slats permanently mounted between the glass assemblies. Means are provided for rotating the slats to open or close them between the glass assemblies. The disadvantage of these slat blinds is that they do not provide an unobstructed view through the window even when fully open. The space between the glass assemblies is relatively narrow and thus many narrow slats must be used to screen the entire glass area. Thus, even when opened, the slats, due to their number, severely limit the view through the window. In addition, the mechanism required to rotate the numerous slats is relatively complicated and costly.

SUMMARY OF THE INVENTION

It is a purpose of the present invention to provide an improved window and blind unit which employs the blind between the inner and outer glass assemblies. The blind is normally stored adjacent the window in a compact rolled position and can be unrolled from its storage position to pass between the glass assemblies to screen the window and/or to insulate it. In accordance with a further feature of the present invention, means are provided in the window unit, between the glass assemblies to securely guide the edges of the blind during its movement into or out of the space between the glass assemblies. These guide means provide a close fit between the blind and the window frame to improve the insulation qualities.

The window and blind unit of the present invention is particularly suited for use with windows having metal window frames. These metal window frames commonly employ inner and outer metal frame sections joined together by plastic spacer means. The plastic spacer means minimizes heat transfer through the frame. In accordance with the present invention, the spacer means are slightly modified to provide the guide means for the blind between the glass areas, without impairing its function as a thermal barrier.

Preferably, the unit is constructed to carry the blind directly on top of the window so that the entire unit can be installed relatively flush in the wall of a building, thereby providing a neat and clean appearance to the installed unit.

The unit is simple in construction, requiring little modification to existing windows to incorporate a blind with the window. The combined unit provides improved insulation qualities, when desired, without obstructing the view when the blind is withdrawn, and without detracting from the appearance of the windows.

The invention is particularly directed toward a combined window and blind unit having a window frame, an inner glass assembly and an outer glass assembly. First mounting means, forming part of the window frame, mount the inner glass assembly therein. Second mounting means, forming part of the window frame and spaced from the first mounting means, mount the outer glass assembly therein. A blind is stored to the side of the inner and outer glass assemblies, and means are provided for moving the blind from its stored position through an opening in the frame into the space between the inner and outer glass assemblies.

BRIEF DESCRIPTION OF THE DRAWINGS

The invention will now be described in detail having reference to the accompanying drawings, in which.

DESCRIPTION OF THE PREFERRED EMBODIMENTS

Figure 1:
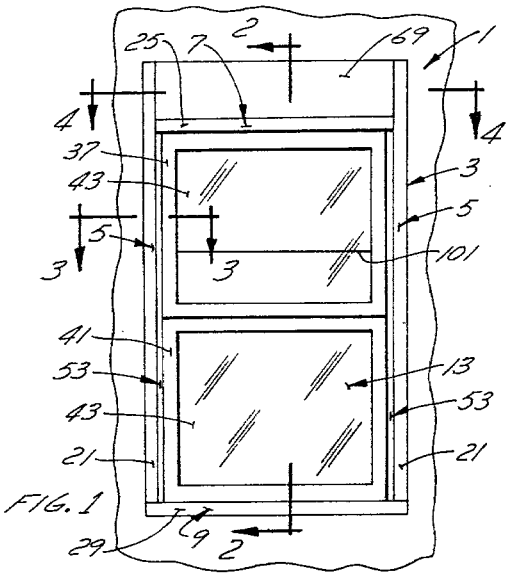
FIG. 1 is an elevation view of a window incorporating a blind according to the present invention.
Figure 2:
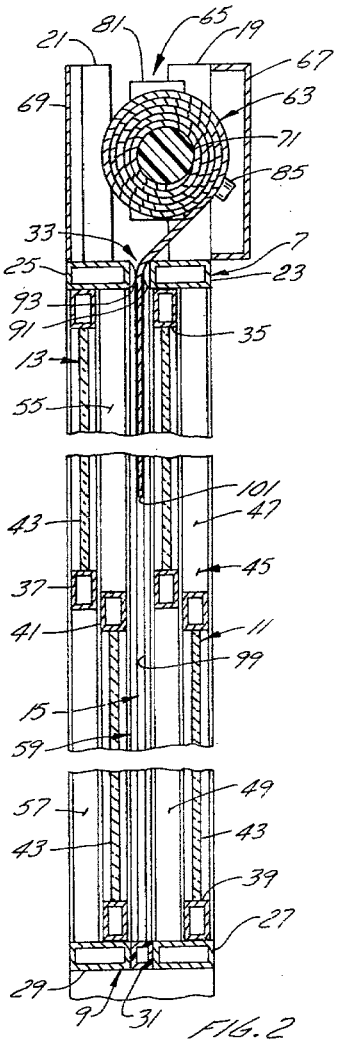
FIG. 2 is a cross-section view taken along line 2—2 of FIG. 1.
Figure 3:
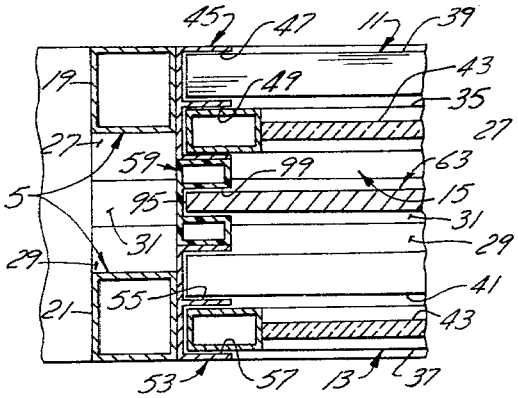
FIG. 3 is a cross-section view taken along line 3—3 of FIG. 1.
Figure 4:
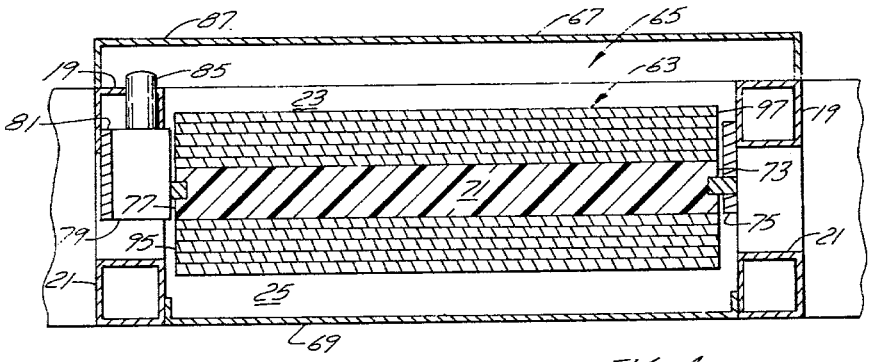
FIG. 4 is a cross-section view taken along line 4—4 of FIG. 1.
Figure 5:
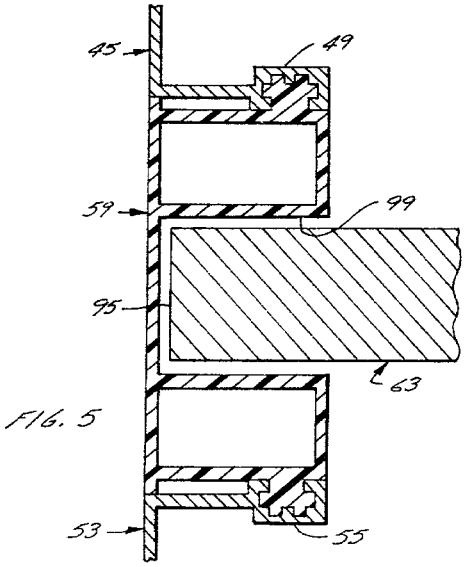
FIG. 5 is an enlarged fragmentary horizontal cross-section of a detail thereof.

The combined window and blind unit 1 of the present invention includes a window frame 3. The window frame 3 has a pair of side frames 5, a top frame 7, and a bottom frame 9. An interior or inner glass assembly 11 and an exterior or outer glass assembly 13 are mounted in the window frame 3. The assemblies 11, 13 are slightly spaced apart to define a narrow space 15 between them.

In more detail, each side frame 5 can comprise a pair of parallel, slightly spaced-apart side frame members 19, 21. The top frame 7 also comprise a pair of parallel, slightly spaced-apart top frame members 23, 25. The inner top frame member 23 extends between inner side frame members 19 and is joined thereto by suitable means (not shown). The outer top frame member 25 extends between outer side frame members 21 and is joined thereto by suitable means (not shown). The bottom frame 9 can also comprise a pair of parallel, spaced-apart bottom frame members 27, 29 with the inner bottom frame member 27 extending between the inner side frame members 19 and joined thereto by suitable means (not shown) and with the outer bottom frame member 29 extending between the outer side frame members 21 and joined thereto by suitable means (not shown). A spacer element 31 preferably connects the bottom frame members 27, 29 together along their adjacent sides. The side frame members 19, 21 in each side frame 5 are connected together in a manner to be described. No connection is made between the top frame members 23, 25 which define a gap 33 between them in the frame opening into the space 15 between the glass assemblies 11, 13.

Each glass assembly 11, 13 preferably comprises an upper sash 35, 37, and a lower sash 39, 41 respectively. The upper and lower sashes 35, 39 and 37, 41 in each assembly 11, 13 respectively 11, 13 respectively overlap. Each sash carries a glass panel 43. First and second means are provided on the side frames 5 for mounting glass assemblies 11, 13 respectively. The first mounting means comprises an inner mounting member 45 fixed to each inner side frame member 19 by suitable means (not shown). The mounting members 45 extend along the side frame members 19 between the top and bottom frames 7, 9. Each mounting member 45 has a pair of parallel channels 47, 49 facing inwardly toward the opposite mounting member. The inner-most channels 47 receive the lower sash 39 of inner glass assembly 11 between them and guide it for vertical movement. The channels 49 receive the upper sash 35 of inner glass assembly 11 and guide it for vertical movement. The second mounting means comprises an outer mounting member 53, similar to inner member 45, fixed by suitable means to each outer side frame member 21. Each outer mounting member 53 has a pair of parallel channels 55, 57 facing inwardly toward the opposite outer mounting member. The inner-most channels 55 receive the lower sash 41 of outer glass assembly 13 and the outer-most channels 57 receive the upper sash 37. The upper and lower sashes of each glass assembly 11, 13 slide in their respective channels to open or close the window, from top or bottom, as desired. A spacer element 59 connects the inner and outer mounting members 45, 53, in each side frame 5, together along their adjacent sides. This serves effectively to connect the side frame members 19, 21 in each side frame 5 together.

In accordance with the present invention, a blind 63 is stored adjacent frame 3. Preferably, the blind 63 is stored in an enclosure 65 above the top frame 7. The enclosure 65 is defined by an inner panel 67 and an outer panel 69, both suitably mounted at their ends to the upper portions of the side frame members 19 and 21 respectively. The upper portions of the side frame members 19, 21 project above the top frame members 23, 25. The blind 63 is fixed at the end to a reel 71 and is wound on the reel when not in use. One end 73 of the reel 71 is rotatably mounted on a first mounting block 75. Block 75 in turn is mounted on one of the inner side frame members 19. The other end 77 of the reel 71 is rotatably mounted to a gear unit 79. The gear unit 79 is in turn mounted on a second mounting block 81 which is mounted on the other of the inner side frame members 19. If desired, both mounting blocks 75, 81 can be mounted to be vertically adjustable along the side frame members 19.

The reel 71 extends horizontally across the top of the window, substantially parallel to the top frame members 23, 25. The gear unit 79 has a downwardly and forwardly directed socket 85. The socket 85 is aligned with an opening 87 in the inner panel 67 of enclosure 65. A crank (not shown) can be inserted through the opening 87 into the socket 85 and operated to rotate the gear unit 79 and to thus rotate the reel 71 to wind or unwind the blind 63. The blind 63 down from the reel 71 through the gap 33 between the top frame members 23, 25 into the space 15 between the inner and outer glass assemblies 11, 13. Guide strips 91, 93 can be provided on each side of the top frame members 23, 25, adjacent the gap 33 to smoothly guide the blind through the gap 33.

In accordance with the present invention, means are provided in the space 15 for guiding the blind 63 by its edges 95, 97 in space 15. These blind guide means preferably comprise a channel 99 formed in each spacer element 59, which element connects the sash mounting members 45, 53 on each side frame 5. The channel 99 in each element 59 faces the opposite channel and both channels 99 receive the edges 95, 97 of the blind 63 to guide the blind during its movement in space 15. The blind fits relatively snugly in the channels 99 and when the bottom edge 101 of the blind touches the bottom spacer element 31 in the bottom frame 9, the space 15 between the inner and outer glass assemblies is effectively screened off and/or insulated depending on the type of blind used.

The invention is particularly adapted for use with metal windows. The frames 5, 7, 9, including the mounting members 45, 53, can all be made from suitable aluminum extrusions, for example. The spacer elements 31, 59, however, are made from suitable material which is a poor conductor of heat, such as plastic. The plastic spacer elements 31, 59 act as a thermal barrier between the metal frame sections, which are a good conductor of heat.

The blind 63 can be made from any suitable material. Preferably, the blind 63 is made from a plurality of hinged aluminum slats. Other suitable constructions can be employed.

I claim:

1. A combined window and blind unit comprising:

a window frame;

an inner glass assembly;

an outer glass assembly;

first mounting means forming part of the window frame for mounting the inner glass assembly therein;

second mounting means forming part of the window frame, spaced from the first mounting means, for mounting the outer glass assembly therein;

a blind stored adjacent the inner and outer glass assemblies; and means for moving the blind from its stored position through an opening in the frame into the space betweem the inner and outer glass assemblies;

spacer means provided between the first and second mounting means, made from a poor heat conducting material, and located within the confines of the first and second mounting means, said first and second mounting means and said spacer means including opposed vertical components, the vertical components of said spacer means including guide means in the form of channels adapted to receive and guide the vertical edges of the blind.

2. A combined window and blind unit as claimed in claim 1, wherein the first and second mounting means are made of metal, and wherein the spacer means are made from plastic.

3. A combined window and blind unit as claimed in claim 1, including a storage reel for the blind, means for rotatably mounting the storage reel above the first and second mounting means, said opening in the frame being located at the top of the frame between the first and second mounting means.

4. A combined window and blind unit as claimed in claim 3, including means for rotating the storage reel in one direction to unwind the blind therefrom, and for rotating the storage reel in the other direction to wind the blind thereon.

5. A combined window and blind unit as claimed in claim 4, including means for enclosing the storage reel, the enclosing means having an opening therein providing access to the rotating means.

* * * * *